US006376144B1

(12) United States Patent
Baumann

(10) Patent No.: US 6,376,144 B1
(45) Date of Patent: Apr. 23, 2002

(54) ORGANIC PHOTOCONDUCTIVE COMPOSITION

(75) Inventor: Harald Baumann, Osterode/Harz (DE)

(73) Assignee: Kodak Polychrome Graphics, LLC, Norwalk, CT (US)

( * ) Notice: Subject to any disclaimer, the term of this patent is extended or adjusted under 35 U.S.C. 154(b) by 0 days.

(21) Appl. No.: 09/631,785

(22) Filed: Aug. 3, 2000

(51) Int. Cl.[7] ..... G03G 5/05
(52) U.S. Cl. ..... 430/96; 430/49
(58) Field of Search ..... 430/96, 56, 49

(56) References Cited

U.S. PATENT DOCUMENTS

| | | | | |
|---|---|---|---|---|
| 3,189,447 A | | 6/1965 | Neugebauer et al. | 430/77 |
| 3,257,203 A | | 6/1966 | Süs et al. | 430/77 |
| 3,540,886 A | * | 11/1970 | Ansel et al. | 430/96 |
| 3,563,736 A | * | 2/1971 | Koehler et al. | 430/96 |
| 3,615,419 A | * | 10/1971 | Field | 430/96 |
| 4,066,453 A | | 1/1978 | Lind et al. | 430/49 |
| 4,492,747 A | | 1/1985 | Brechlin | 430/96 |
| 4,525,444 A | | 6/1985 | Doessel | 430/96 |
| 4,528,256 A | | 7/1985 | Lind | 430/83 |
| 4,933,248 A | | 6/1990 | Lind et al. | 430/83 |
| 5,035,968 A | * | 7/1991 | Horie et al. | 430/96 |
| 5,126,504 A | | 6/1992 | Mueller-Hess | 430/96 |
| 5,496,672 A | * | 3/1996 | Akimoto et al. | 430/96 |
| 5,744,272 A | | 4/1998 | Elaesser et al. | 430/96 |

FOREIGN PATENT DOCUMENTS

CA 1146794 5/1983

OTHER PUBLICATIONS

Alger, Mark S. Polymer Science Dictionary. New York: Elsevier Applied Science. pp. 385–386 (1989).*

* cited by examiner

*Primary Examiner*—Christopher Rodee
(74) *Attorney, Agent, or Firm*—Ratner & Prestia

(57) ABSTRACT

A photoconductive composition useful for the preparation of printing plates is disclosed. The composition comprising an organic photoconductor, a charge carrier generating material, and a binder comprising a mixture of at least two copolymers. Copolymer (a) comprises an aromatic vinyl monomer, such as styrene or a substituted styrene, and maleic acid anhydride ring opened with a first aliphatic alcohol. Copolymer (b) comprises the following monomers: $CH_2{=}CH{-}(CH_2)_n{-}OR$, in which n is 0 or 1, and R is selected from the group consisting of hydrogen, aliphatic groups having 1 to about 10 carbon atoms, and —COR' in which R' is an aliphatic group having 1 to about 10 carbon atoms, such as vinyl alcohol; maleic acid anhydride ring opened by a second aliphatic alcohol; and optionally $CH_2{=}CH{-}R''$, in which R" is a substituted or unsubstituted aromatic residue comprising from about 6 to about 20 ring atoms selected from the group consisting of carbon, oxygen, nitrogen, and sulfur, in which not more than 3 ring atoms are selected from the group consisting of oxygen, nitrogen and sulfur.

31 Claims, No Drawings

ORGANIC PHOTOCONDUCTIVE COMPOSITION

FIELD OF THE INVENTION

The invention relates to a photoconductive composition useful for the preparation of printing plates. In particular, the invention relates to a composition comprising an organic photoconductor, a charge carrier generating material, and polymeric binders, to a printing plate precursor comprising the photoconductive composition, and to a method for imaging the printing plate precursor.

BACKGROUND OF THE INVENTION

Printing plate precursors, especially lithographic printing plate precursors, can be obtained by applying a photosensitive coating to a substrate. The precursor is imagewise exposed to radiation, such as ultraviolet light or infrared radiation, and developed with an alkaline developer in order to obtain an imaged printing plate. Depending on whether the exposed areas are removed from or remain on the plate during developing, such plates are called positive-working plates and negative-working plates, respectively. The different solubility of exposed and unexposed areas in the developer is due to a photoreaction of the photosensitive layer during exposure to ultraviolet or infrared radiation.

Besides such kinds of printing plate precursors, there exist also electrophotographic systems. The process for imaging such plates includes the following steps:(1) corona charging, (2) imagewise exposure to radiation and thereby discharging of the exposed parts, (3) applying a dry or liquid toner thereto, (4) fixing the toner by heating and (5) removing the non-image areas by a stripper. Photoconductive materials for such electrophotographic printing plate systems are well known in the art. They are also used for the production of printed circuits.

Electrophotographic plates must meet the following general requirements:

(1) The charging of the plate should be high.

(2) The dark decay should be as low as possible.

(3) The photodecay of the charged plate should be high.

(4) There should be a fast developability and—if any—only a low change of developability after thermal treatment for toner fixing.

(5) The adhesion of the toner should be high.

(6) Only a low amount of sludge should be formed in the developing machines.

Whether these requirements are met and to which extent mainly depends on the polymeric binder used in the photoconductive layer. Therefore, research in this field has concentrated on the development of suitable binders.

Elsaesser, U.S. Pat. No. 5,744,272, discloses a photoconductive composition for lithographic printing plates that comprises an organic photoconductor, a sensitizer and a binder. The binder comprises a mixture of (a) a copolymer comprising units composed of a first vinyl aromatic compound (e.g., styrene) and units composed of maleic anhydride and/or a maleic partial ester, and (b) a copolymer comprising units composed of a second vinyl aromatic compound (e.g. styrene) and units of (meth)acrylic acid. Electrophotographic plates obtained from such a composition, however, show an insufficient developer capacity.

The photoconductive compositions disclosed in EP-A-0 420 002 [Mueller-Hess, U.S. Pat. No. 5,126,504] comprise a graft polymer with polyurethane being the graft basis to which vinyl alcohol units are grafted; the hydroxyl groups of the vinyl alcohol are carboxylated by maleic acid anhydride. Although such a recording material shows good properties there is the disadvantage that the synthesis of the binder is very complex and, therefore, is relatively expensive to manufacture.

EP-A-0 324 180 [Lind, U.S. Pat. No. 4,933,248] provides a photoconductive composition comprising an organic photoconductor, a sensitizer and an optionally substituted polyvinyl phenol resin as binder. Besides homopolymers, copolymers of vinylphenols and other vinyl compounds such as styrene or acrylic acid esters can be used. In addition to the vinyl phenol binder, additional binders can be used that may, for instance, be selected from copolymers of styrene and maleic acid anhydride and their partial esters, polyvinylacetates, polyacrylates, and the like. However, the developability in aqueous developers ("strippers") of a printing form obtained from such a composition is insufficient. The developer has to be strong alkaline, which makes it very sensitive to carbon dioxide from the air.

Another electrophotographic recording material is disclosed in EP-B- 0 089 603. The photoconductive layer thereof comprises, besides a photoconductor, a sensitizer and optional other additives, a polymeric binder which is the reaction product of a sulfonyl isocyanate and a hydroxyl containing polymer like a vinyl alcohol copolymer (e.g. polyvinyl butyral), a polyester and a cellulose ester. Like the material of EP-A-0 324 180, this material shows an insufficient developability and requires a strong alkaline developer.

Therefore, a need exits for a photoconductive composition useful for the preparation of printing plates and printed circuits, which produces electrophotographic recording materials meeting requirements (1) to (6), but which does not require an expensive binder, has sufficient developability, and does not require a strong alkaline developer.

SUMMARY OF THE INVENTION

In one embodiment the invention is a photoconductive composition comprising:

(1) at least one organic photoconductor;

(2) at least one charge carrier generating material; and (3) a binder comprising:

(a) at least one copolmyer comprising an aromatic vinyl monomer and maleic acid anhydride ring opened by a first aliphatic alcohol, and (b) at least one copolymer comprising the following monomers:

(i) $CH_2{=}CH{-}(CH_2)_n{-}OR$, in which n is 0 or 1, and R is selected from the group consisting of hydrogen, aliphatic groups having 1 to about 10 carbon atoms, and —COR' in which R' is an aliphatic group having 1 to about 10 carbon atoms, and (ii) maleic acid anhydride ring opened by a second aliphatic alcohol.

In one embodiment, copolymer (b) additionally comprises monomer (iii): $CH_2{=}CH{-}R''$, in which R" is a substituted or unsubstituted aromatic residue comprising from about 6 to about 20 ring atoms, the ring atoms selected from the group consisting of carbon, oxygen, nitrogen, and sulfur, in which not more than 3 ring atoms are selected from the group consisting of oxygen, nitrogen and sulfur.

In another embodiment, the invention is an electrophotographic recording element that comprises a substrate and a photoconductive layer comprising the photoconductive composition. In still another embodiment, the invention is a method for forming an image, typically an imaged and developed printing plate, using the electrophotographic recording element.

DETAILED DESCRIPTION OF THE INVENTION

When used in this application, the term "alkyl" includes straight chain, branched and cyclic alkyl groups unless defined otherwise; the same applies to alkyl moieties of alkoxy groups.

The photoconductive composition comprises at least one organic photoconductor. Suitable organic photoconductors are, for example, compounds based on aromatic rings or aromatic heterocycles, which may have one or more substituents, preferably basic amino groups. Such photoconductors are described, for example, in Neugebauer, U.S. Pat. No. 3,189,447; Sus, U.S. Pat. No. 3,257,203; DE-A-29 49 826 [CA 1,146,794]; and EP-A-0 125 481 [Lind, U.S. Pat. No. 4,528,256]. More preferably, the organic photoconductors are derived from oxadiazoles or oxazoles, triphenylamines, triphenylmethans, more highly condensed aromatic hydrocarbons such as anthracene, benzofused heterocycles, pyrazolines, hydrazones, imidazoles or triazoles. Most preferred are oxadiazoles, oxazoles, aromatic hydrazones, pyrazolines and triarylamines. The photoconductors may be used individually or as mixtures. The proportion of organic photoconductor is preferably about 14 to about 75% by weight, based on the total weight of the nonvolatile constituents of the photoconductive composition, more preferably about 25 to about 50% by weight.

A further essential component is the charge carrier generating material (also called a "sensitizer"), which is usually an organic dye or pigment.

Sensitizing dyes and pigments are disclosed, for example, in Mueller-Hess, U.S. Pat. No. 5,126,504, column 8, line 45, to column 10, line 15, the disclosure of which is incorporated herein by reference. Sensitizers can be used individually or as mixtures. Preferably the sensitizer is selected from the group consisting of triarylmethane dyes, such as brilliant green (C.I. 42040) victoria blue B (C.I. 44045), crystal violet (C.I. 42555), and malachite green (C.I. 42000); xanthene dyes, such as rhodamine B (C.I. 45170) rhodamine 6G (C.I. 45160), eosin B (C.I. 45430), rose bengal (C.I. 45440), and fluorescein (C.I. 45330); thiazine dyes, such as methylene blue (C.I. 52015); acridine dyes, such as acridine orange (C.I. 46005) and acridine yellow (C.I. 46025); quinoline dyes, quinone and ketone dyes, polymethine dyes, and cyanine dyes. Although the amount used will depend on the nature of the light source, the sensitizers are typically used in the weight ratio of about 0.001 to about 0.1 parts by weight sensitizers per part by weight of photoconductor.

The polymeric binder used is a mixture comprising at least one copolymer (a) and at least one copolymer (b). Copolymer (a) comprises, in polymerized form, an aromatic vinyl monomer and maleic acid anhydride that has been ring opened with a first aliphatic alcohol. Preferably essentially no other monomers are present in copolymer (a).

Examples of the aromatic vinyl monomer used for the preparation of copolymer (a) are: mononuclear, binuclear or trinuclear aromatic compounds which, in addition to the vinyl group, may also carry other substituents. These substituents include, for example, $C_1$–$C_4$ alkyl, $C_6$–$C_{10}$ aryl, $C_1$–$C_4$ alkoxy or aryloxy groups, or halogen atoms. Preferred are mononuclear vinyl aromatics, that is, styrene and substituted styrenes. Examples of substituted styrenes include vinyltoluene (methyl styrene), vinylxylene, p-chlorostyrene, vinylanisole (methoxy styrene), α-methylstyrene and α-chlorostyrene.

The first aliphatic alcohol is preferably a lower alcohol having 1 to about 6 carbon atoms. Methanol, ethanol, propanol and n-butanol are especially preferred.

Copolymer (b) comprises the following monomers:

(i) $CH_2{=}CH{-}(CH_2)_n{-}OR$, in which n is 0 or 1, and R is selected from the group consisting of hydrogen, aliphatic groups having 1 to about 10 carbon atoms, and —COR' in which R' is an aliphatic group having 1 to about 10 carbon atom;

(ii) maleic acid anhydride ring opened by a second aliphatic alcohol, and (iii) $CH_2{=}CH{-}R''$, in which R" is a substituted or unsubstituted aromatic residue comprising from about 6 to about 20 ring atoms selected from the group consisting of carbon, oxygen, nitrogen, and sulfur, in which not more than 3 ring atoms are selected from the group consisting of oxygen, nitrogen and sulfur.

Copolymer (b) contains, in polymerized form, one or more monomers of formula (i) and one or more monomers of formula (ii). Copolymer (b) may also comprise, in polymerized form, one or more monomer of formula (iii). In one embodiment, essentially no other monomers, other monomer (i), monomer (ii), and, optionally, monomer (iii), are present in copolymer (b).

In monomer (i), n is preferably 0. R is preferably hydrogen. R and R' are each preferably a $C_1$–$C_{10}$ alkyl group, more preferably a $C_1$–$C_4$ alkyl group, and most preferably methyl or ethyl.

In monomer (ii), the second aliphatic alcohol is preferably a lower alcohol having 1 to about 6 carbon atoms. Methanol, ethanol, propanol and n-butanol are especially preferred.

In monomer (iii), R" is preferably a mononuclear aromatic group which, in addition to the vinyl group, may be substituted by 1 to 3 substituents selected from the group consisting of $C_1$–$C_4$ alkyl, $C_1$–$C_4$ alkoxy and halogen atoms. Preferably the aromatic moiety of the aromatic group does not comprise any atoms selected from the group consisting of oxygen, nitrogen, and sulfur. Most preferably, monomer (iii) is selected from the group consisting of styrene, α-methylstyrene and α-chlorostyrene.

The binder, i.e. the mixture of at least one copolymer (a) and at least one copolymer (b), is preferably present in the photoconductive composition in an amount of about 20 to about 85% by weight based on the total weight of the nonvolatile constituents of the photoconductive composition, more preferably about 40 to about 80% by weight, most preferably about 50 to about 70% by weight. The weight ratio of copolymer (a) to copolymer (b) is preferably about 2:1 to about 20:1, more preferably about 5:1 to about 15:1, most preferably about 8:1 to about 12:1. The molecular weights of copolymer (a) and copolymer (b) are preferably in the range of about 20,000 to about 300,000, more preferably from about 50,000 to about 200,000. The molar ratio of aromatic vinyl monomer and ring opened maleic acid anhydride in copolymer (a) is preferably from about 2:1 to about 1:1, more preferably from about 1.5:1 to 1:1, even more preferably about 1.2:1 to about 1:1, and especially preferred 1:1. If copolymer (b) is derived from at least monomers (i), (ii) and (iii), the unit derived from monomer (i) is preferably present in an amount of about 10 to about 50 mol-% based on copolymer (b), more preferably from 30 to 50 mol-%; the amount of unit (ii) derived from ring opened maleic acid anhydride is preferably from about 10 to about 50 mol-%, more preferably from 40 to 50 mol-%; the amount of the unit derived from monomer (iii) is preferably more than 0 to about 40 mol-%, more preferably from 2 to 30 mol-%. If copolymer (b) does not contain a unit derived from monomer (iii), the molar ratio of monomer (i) to monomer (ii) is preferably from about 1.2:1 to 1:1, more preferably from about 1. 1:1 to 1:1.

The photoconductive composition may comprise one or more conventional additives, such as dyes and pigments, surfactants, and plastizicers. As is well known to those skilled in the art, dyes and pigments may be used to increase the image contrast.

The invention also provides electrophotographic recording elements comprising a conductive substrate and a photoconductive layer thereon, which is obtained by applying the photoconductive composition to a conductive substrate.

Materials such as aluminum plates, zinc plates, magnesium plates, copper plates or multimetal plates may be used as substrate. Surface-finished aluminum sheets have proven particularly satisfactory. The surface finish, if employed, comprises a mechanical and/or electrochemical graining of the substrate and optionally a subsequent anodizing and hydrophilizing treatment for instance with polyvinylphosphonic acid. By employing a surface finish, the length and/or volume of the print run is likely increased. The use of a surface finish on the substrate may also reduce the susceptibility to oxidation. Also suitable are films of cellulose hydrate, cellulose acetate or cellulose butyrate, polyamide films with a layer of vaporized metal. Conductive polymers can also be used.

A solution of the photoconductive composition is applied to the surface of the optionally pretreated conductive substrate. The dry coating weight of the obtained photoconductive layer is preferably from about 2 to about 10 g/m$^2$, more preferably from about 4 to about 7 g/m$^2$.

To image the electrophotographic recording element, the surface of the layer of photoconductive composition is charged, to form a charged layer, and subsequently exposed imagewise to form exposed and unexposed regions. Then dry or liquid electrostatic toner is applied and fixed by heating. The toner adheres to the unexposed regions of the layer. Finally, the exposed regions are removed by a stripper.

The charging of the electrophotographic recording element is carried out by usual means, such as by corona. Preferably corona of about 3 to about 15 kV is applied. The imagewise exposure of the charged electrophotographic recording element can be carried out in an analog or digital process. Suitable radiation sources are those that emit visible light, infrared radiation or ultraviolet radiation. These radiation sources are well known to those skilled in the art and include for example, mercury vapor lamps, infrared and visible lasers, etc. If ultraviolet radiation is used it is possible to omit the sensitizer in the photoconductive composition. It is preferred to use visible light.

Either dry or liquid toners can be used. The toner is fixed by heating the plate preferably to about 110 to 200° C., more preferably to about 130 to 160° C.

Stripping of the non-image areas can be done by aqueous alkaline strippers (sometimes also called "developers"). The pH thereof is preferably in the range of about 8 to about 14, more preferably about 10 to 12. The aqueous stripper can optionally comprise up to about 10 vol.-% of an organic solvent to improve removal of the non-toner-covered areas ("non-image areas"). Suitable solvents are, for example, benzyl alcohol and phenoxyethanol.

INDUSTRIAL APPLICABILITY

The photoconductive composition provides electrophotographic elements, or plates, with high photospeed, low dark decay, fast developability in water based alkaline strippers, low tendency to deposition and slugging of plate materials within the tanks and on the rollers of developing machines, as well as high plate throughput. In addition, the plates are advantageous from an economical point of view due to low costs for the components used for the photoconductive layer.

The advantageous properties of the invention may be observed by reference to the following examples, which illustrate, but do not limit the invention.

EXAMPLES

Synthesis Examples 1

Synthesis of a Copolymer of Styrene, Vinyl Alcohol, and Maleic Acid Anhydride Ring Opened by Ethanol 23.6 g of maleic acid anhydride was dissolved in 206 mL of toluene. Nitrogen was bubbled through the solution, and it was heated up to 76° C. Within 30 min, a solution of 12.5 g of styrene, 10.3 g of vinyl acetate, and 50 mg of azobisisobutyrlnitrile (AIBN) were added with stirring. The solution was kept at 76° C. for 6 hr. The precipitated copolymer was filtered off, washed with petroleum ether and dried in vacuum at 40° C.

8 g of this copolymer was dissolved in 120 mL of ethanol containing 0.1 mol/L p-toluene sulfonic acid, and the solution heated at reflux for 1 hr. The copolymer was isolated by precipitation in water and dried at 40° C. in vacuum. Analysis of the copolymer indicates that the molar ratio of the monomers in the copolymer corresponds to the ratio of monomers used for the polymerization.

Synthesis Example 2

Synthesis of a Copolymer of Vinyl Alcohol and Maleic Acid Anhydride Ring Opened by Ethanol 47.2 g of maleic acid anhydride was dissolved in 400 mL of toluene. Nitrogen was bubbled through the solution, and it was heated up to 76° C. Within 30 min, a solution of 41.4 g vinyl acetate, and 100 mg AIBN were added with stirring. The solution was kept at 76° C. for 6 hr. The precipitated copolymer was filtered off, washed with petroleum ether, and dried in vacuum at 40° C.

20 g of this copolymer was dissolved in 300 mL of ethanol containing 1 mol/L p-toluene sulfonic acid, and the solution heated at reflux for 1 hr. The copolymer was isolated by precipitation in water and dried at 40° C. in vacuum. Analysis of the copolymer indicates that the molar ratio of the monomers in the copolymer corresponds to the ratio of monomers used for the polymerization.

Synthesis Example 3

Synthesis of a Copolymer of Vinyl Alcohol and Maleic Acid Anhydride Ring Opened by Methanol 23.6 g of maleic acid anhydride was dissolved in 206 mL of toluene. Nitrogen was bubbled through the solution and it was heated up to 76° C. Within 30 min, a solution of 12.5 g of styrene, 10.3 g of vinyl acetate, and 50 mg of AIBN was added with stirring. The solution was kept at 76° C. for 6 hours. Then the precipitated copolymer was filtered off, washed with petroleum ether, and dried in vacuum at 40° C.

16 g of this polymer was dissolved in 240 mL of methanol containing 0.1 mol/L p-toluene sulfonic acid, and the solution heated at reflux for 3 hr. The copolymer was isolated by precipitation in water and dried at 40° C. in vacuum. Analysis of the copolymer indicates that the molar ratio of the monomers in the copolymer corresponds to the ratio of monomers used for the polymerization.

Examples 1 to 4 and Comparative Examples 1 to 5

Preparation of the Plates

A coating solution was prepared by dissolving the components given in Table 1. After the solution was filtered, it was applied to an electrochemically roughened and anodized aluminum foil that was subjected to an aftertreatment using an aqueous solution of polyvinyl phosphonic acid by means of conventional methods and dried for 4 min at 90° C. The coating weight was 5.7 g/$m^2$.

Evaluation of the Plates

The electrophotographic plates were charged with a corona of 8 kV. The dark decay and the light decay (white light exposure with 4.3 Lux) were measured with a Monroe-probe (Monroe Electronics, Lyndonville, N.Y.). The results of the evaluation are summarized in Table 2, in which:

| | |
|---|---|
| $U_0$ | voltage direct after charging in volt |
| DD | dark decay calculated by $U_{D20}$*100%/$U_{D70}$ |
| LD | light decay calculated by $U_{L20}$*100%/$U_{L70}$ |
| $U_{D20}$ | voltage 20 sec after stop of charging (without exposure) |
| $U_{D70}$ | voltage 70 sec after stop of charging (without exposure) |
| $U_{L20}$ | voltage 20 sec after stop of charging (with exposure) |
| $U_{L70}$ | voltage 70 sec after stop of charging (with exposure) |

To prepare a lithographic plate, a POLYCHROME® 2500 camera was used. In this camera, the plate was charged with a corona of 8 kV and then exposed for 14 seconds to four 1500W xenon lamps (from film front side) and for 14 seconds to white light tubes (from film back side) using a positive transparent test target containing 54 lines/cm screens with tonal values of 1 to 99%. The charge image was developed with the Liquid Toner 405 from Kodak Polychrome Graphics and fixed by heating at about 130° C. In a developing bath, the non-toner covered image areas were developed with Developer 505 from Kodak Polychrome Graphics (soak time 15 seconds) at 23°0 C.

The following parameters were considered for plate evaluation:

| | |
|---|---|
| Reproduction quality: | Reproduced dot range of a 54 lines/cm screen |
| Developability speed: | Time in seconds necessary to develop the non toner-covered photoconductor layer after thermal treatment for toner fixing with developer 505 diluted 1 + 2 with water |
| Developer capacity: | $m^2$ of plates per liter developer 505 that can be processed clean; to test the cleanness, a drop of methyl ethyl ketone was applied to the plate and with ink was tested whether the edges of the formed circle are clean or not. Additionally, a visual evaluation of sludge formation on the rollers and tank was made |
| Length of run: | Maximum of copies obtained on sheet fed offset printing machine before wear of the toner image is visible |

The results in Table 2 show an improved developability/developer capacity without negative effect on electrophotographic data, reproduced dot range and length of run for the examples of this invention. The synergistic effect of combining copolymers (a) and (b) becomes clear with Comparative Examples 1 to 5 in which either copolymer (a) or copolymer (b) is used alone. The inventive Examples 1 to 5 are superior to Comparative Example 6 (which is according to Elsaesser, U.S. Pat. No. 5,744,272) with respect to developer capacity.

Comparative Examples 7 and 8 demonstrate the insufficient developability/developer capacity for electrophotographic plates using poly(vinyl phenol) as in EP 0 324 180[Lind, U.S. Pat. No. 4,933,248] or the reaction product of the hydroxyl groups of poly(vinyl butyral) with toluene sulfonyl isocyanate, as described in EP 0 089 603 [Doessel, U.S. Pat. No. 4,525,444].

Having described the invention, we now claim the following and their equivalents.

TABLE 1

| | Examples | | | | Comparative Examples | | | | | | | |
|---|---|---|---|---|---|---|---|---|---|---|---|---|
| Components | 1 | 2 | 3 | 4 | 1 | 2 | 3 | 4 | 5 | 6 | 7 | 8 |
| 2,2-bis-4,4'-diethylaminophenyl-1,3,4-oxadiazole | 3.97 g | 3.97 g | 3.97 g | 3.97 g | 3.97 g | 3.97 g | 3.97 g | 3.97 g | 3.97 g | 3.97 g | 3.97 g | 3.97 g |
| 2-phenyl-4-(2-chlorophenyl)-5-(4-diethylaminophenyl)-oxazole-1,3 | 7.93 g | 7.93 g | 7.93 g | 7.93 g | 7.93 g | 7.93 g | 7.93 g | 7.93 g | 7.93 g | 7.93 g | 7.93 g | 7.93 g |
| SCRIPSET ® 540[1)] | 16.43 g | 14.3 g | 16.1 g | 16.1 g | 17.9 g | | | | | 16.1 g | | |
| GANTREZ ® S-95[2)] | 1.43 g | | | | | 17.9 g | | | | | | |
| binder of synthesis example 1 | | 3.56 g | | | | | 17.9 g | | | | | |
| binder of synthesis example 2 | | | 1.78 g | | | | | 17.9 g | | | | |
| binder of synthesis example 3 | | | | 1.78 g | | | | | 17.9 g | | | |
| Comparative binder 1[3)] | | | | | | | | | | 1.78 g | | |
| Comparative binder 2[4)] | | | | | | | | | | | 17.9 g | |
| Comparative binder 3[5)] | | | | | | | | | | | | 17.9 g |
| Simbase Yellow[6)] | 0.177 g | 0.177 g | 0.177 g | 0.177 g | 0.177 g | 0.177 g | 0.177 g | 0.177 g | 0.177 g | 0.177 g | 0.177 g | 0.177 g |
| Basazol Red 718[7)] | 0.069 g | 0.069 g | 0.069 g | 0.069 g | 0.069 g | 0.069 g | 0.069 g | 0.069 g | 0.069 g | 0.069 g | 0.069 g | 0.069 g |
| methanol | 100 mL | 100 mL | 100 mL | 100 mL | 100 mL | 100 mL | 100 mL | 100 mL | 100 mL | 100 mL | 100 mL | 100 mL |
| tetrahydrofuran | 80 mL | 80 mL | 80 mL | 80 mL | 80 mL | 80 mL | 80 mL | 80 mL | 80 mL | 80 mL | 80 mL | 80 mL |
| propyleneglycol | 20 mL | 20 mL | 20 mL | 20 mL | 20 mL | 20 mL | 20 mL | 20 mL | 20 mL | 20 mL | 20 mL | 20 mL |

TABLE 1-continued

| | Examples | | | | Comparative Examples | | | | | | | |
|---|---|---|---|---|---|---|---|---|---|---|---|---|
| Components | 1 | 2 | 3 | 4 | 1 | 2 | 3 | 4 | 5 | 6 | 7 | 8 |
| monomethyl ether | | | | | | | | | | | | |

[1]copolymer of styrene and maleic acid half ester from Mansanto, molecular weight 1800 000, acid number 185
[2]copolymer of methyl vinyl ether and maleic acid from ISP
[3]copolymer of styrene and acrylic acid, acid number 270, Suprapal WS from BASF
[4]polyvinyl butyral modified with p-toluenesulfonylisocyanate, acid number 30
[5]polyvinyl phenol
[6]4,4'-(Iminocarbonyl)-bis-(N,N-dimethyl)anilinhydrochloride, C.I. Basic Yellow 2 from Simpson Ltd. (UK)
[7]N,N,N',N'-tetraethylrhodamin from BASF

TABLE 2

| | Examples | | | | Comparative Examples | | | | | | | |
|---|---|---|---|---|---|---|---|---|---|---|---|---|
| | 1 | 2 | 3 | 4 | 1 | 2[1] | 3 | 4 | 5 | 6 | 7 | 8 |
| $U_0$[V] | 800 | 725 | 720 | 736 | 715 | — | 620 | 599 | 589 | 696 | 620 | 705 |
| dark decay DD[%] | 91.7 | 93.2 | 93.4 | 93.0 | 93.4 | — | 84.3 | 82.8 | 81.4 | 93.4 | 85.2 | 98.2 |
| light decay LD[%] | 37.6 | 37.5 | 43.5 | 40.3 | 41.7 | — | 50.1 | 51.3 | 49.7 | 37.8 | 43.9 | 47.9 |
| dot range [%] | 4–96 | 4–96 | 4–97 | 4–97 | 10–97 | — | 20–90 | 20–90 | 20–90 | 4–96 | 10–90 | 10–95 |
| developing speed[s] | 20 | 25 | 15 | 20 | >60 | — | 10 | 15 | 10 | 25 | 55 | 45 |
| developer capacity [$m^2$/L] | >14 | >14 | >14 | >14 | 10 | — | >14 | >14 | >14 | 11 | 8 | 9 |
| length of | >150,000 | >150,000 | >150,000 | >150,000 | >150,000 | — | >150,000 | >150,000 | >150,000 | >150,000 | >150,000 | >150,000 |

[1]could not be measured because of coating solution was turbid.

What is claimed is:

1. A photoconductive composition comprising:

(1) at least one organic photoconductor;

(2) at least one sensitizer; and (3) a binder comprising:

(a) at least one copolymer comprising, in polymerized form, an aromatic vinyl monomer and maleic acid anhydride ring opened by a first aliphatic alcohol, and (b) at least one copolymer comprising, in polymerized form, the following monomers:

(i) $CH_2{=}CH{-}(CH_2)_n{-}OR$, in which n is 0 or 1, and R is selected from the group consisting of hydrogen, aliphatic groups having 1 to about 10 carbon atoms, and —COR' in which R' is an aliphatic group having 1 to about 10 carbon atoms, and (ii) maleic acid anhydride ring opened by a second aliphatic alcohol;

in which the composition is developable by an aqueous alkaline developer.

2. The photoconductive composition of claim 1 in which the first aliphatic alcohol and the second aliphatic alcohol each comprise 1 to 6 carbon atoms.

3. The photoconductive composition of claim 1 in which the aromatic vinyl monomer of copolymer (a) is selected from the group consisting of styrene and substituted styrenes.

4. The photoconductive composition of claim 1 in which the molar ratio of aromatic vinyl monomer and ring opened maleic acid anhydride in copolymer (a) is from about 2:1 to 1:1.

5. The photoconductive composition of claim 1 in which copolymer (b) consists essentially of monomer (i) and monomer (ii), and in which the molar ratio of monomer (i) to monomer (ii) is from about 1.2:1 to 1:1.

6. The photoconductive composition of claim 1 in which the mixture of copolymer (a) and copolymer (b) together comprise about 20 to about 85% by weight based on the total weight of the nonvolatile constituents of the photoconductive composition.

7. The photoconductive composition of claim 1 in which the weight ratio of copolymer (a) to copolymer (b) is about 2:1 to about 20:1.

8. The photoconductive composition of claim 7 in which copolymer (b) consists essentially of monomer (i) and monomer (ii), and in which the molar ratio of monomer (i) to monomer (ii) is from about 1.2:1 to 1:1.

9. The photoconductive composition of claim 1 in which the organic photoconductor comprises about 14 to about 75% by weight of the total weight of the nonvolatile constituents of the photoconductive composition.

10. The photoconductive composition of claim 1 in which the sensitizer is selected from the group consisting of triarylmethane dyes, xanthene dyes, thiazine dyes, acridine dyes, quinoline dyes, quinone and ketone dyes, polymethine dyes, and cyanine dyes.

11. The photoconductive composition of claim 1 in which the amount of sensitizer is about 0.001 to about 0.1 parts by weight per part based on the weight of the organic photoconductor.

12. The photoconductive composition of claim 1 further comprising at least one additive selected from the group consisting of dyes and pigments for increasing the image contrast, surfactants and plastizicers.

13. A photoconductive composition comprising:

(1) at least one organic photoconductor;

(2) at least one sensitizer; and (3) a binder comprising:

(a) at least one copolymer comprising, in polymerized form, an aromatic vinyl monomer and maleic acid anhydride ring opened by a first aliphatic alcohol, and (b) at least one copolymer comprising, in polymerized form, the following monomers:

(i) vinyl alcohol, and (ii) maleic acid anhydride ring opened by a second aliphatic alcohol.

14. The photoconductive composition of claim 13 in which the photoconductive composition is developable by an aqueous alkaline developer.

15. A photoconductive composition comprising:

(1) at least one organic photoconductor;

(2) at least one sensitizer; and (3) a binder comprising:

(a) at least one copolymer comprising, in polymerized form, an aromatic vinyl monomer and maleic acid anhydride ring opened by a first aliphatic alcohol, and (b) at least one copolymer comprising, in polymerized form, the following monomers:

(i) $CH_2{=}CH{-}(CH_2)_n{-}OR$, in which n is 0 or 1, and R is selected from the group consisting of hydrogen, aliphatic groups having 1 to about 10 carbon atoms, and —COR' in which R' is an aliphatic group having 1 to about 10 carbon atoms, (ii) maleic acid anhydride ring opened by a second aliphatic alcohol, and (iii) $CH_2{=}CH{-}R''$, in which R" is a substituted or unsubstituted aromatic residue comprising from about 6 to about 20 ring atoms selected from the group consisting of carbon, oxygen, nitrogen, and sulfur, in which not more than 3 ring atoms are selected from the group consisting of oxygen, nitrogen and sulfur.

16. The photoconductive composition of claim 15 in which monomer (iii) is selected from the group consisting of styrene, α-methylstyrene and α-chlorostyrene.

17. The photoconductive composition of claim 16 in which monomer (iii) is styrene.

18. A photoconductive composition comprising:

(1) at least one organic photoconductor selected from the group consisting of oxadiazoles, oxazoles, pyrazolines, aromatic hydrazones, and triarylamines;

(2) at least one sensitizer; and (3) a binder comprising:

(a) at least one copolymer comprising, in polymerized form, an aromatic vinyl monomer and maleic acid anhydride ring opened by a first aliphatic alcohol, and (b) at least one copolymer comprising, in polymerized form, the following monomers:

(i) $CH_2{=}CH{-}(CH_2)_n{-}OR$, in which n is 0 or 1, and R is selected from the group consisting of hydrogen, aliphatic groups having 1 to about 10 carbon atoms, and —COR' in which R' is an aliphatic group having 1 to about 10 carbon atoms, and (ii) maleic acid anhydride ring opened by a second aliphatic alcohol.

19. A photoconductive composition comprising:

(1) at least one organic photoconductor;

(2) at least one sensitizer; and (3) a binder comprising:

(a) at least one copolymer comprising, in polymerized form, an aromatic vinyl monomer and maleic acid anhydride ring opened by a first aliphatic alcohol, and (b) at least one copolymer comprising, in polymerized form, the following monomers:

(i) vinyl alcohol, and (ii) maleic acid anhydride ring opened by a second aliphatic alcohol;

in which:

the first aliphatic alcohol and the second aliphatic alcohol each comprise 1 to 6 carbon atoms;

the aromatic vinyl monomer of copolymer (a) is selected from the group consisting of styrene and substituted styrenes;

the molar ratio of aromatic vinyl monomer and ring opened maleic acid anhydride in copolymer (a) is from about 2:1 to 1:1;

the mixture of copolymer (a) and copolymer (b) together comprise about 20 to about 85% by weight based on the total weight of the nonvolatile constituents of the photoconductive composition;

the weight ratio of copolymer (a) to copolymer (b) is about 2:1 to about 20:1;

the organic photoconductor is selected from the group consisting of oxadiazoles, oxazoles, pyrazolines, aromatic hydrazones and triarylamines; and the sensitizer is selected from the group consisting of triarylmethane dyes, xanthene dyes, thiazine dyes, acridine dyes, quinoline dyes, quinone and ketone dyes, polymethine dyes, and cyanine dyes.

20. The photoconductive composition of claim 19 in which copolymer (b) consists essentially of monomer (i) and monomer (ii), and in which the molar ratio of monomer (i) to monomer (ii) is from about 1.2:1 to 1:1.

21. The photoconductive composition of claim 19 in which copolymer (b) further comprises, in polymerized form, monomer (iii), and monomer (iii) is selected from the group consisting of styrene, α-methylstyrene and α-chlorostyrene.

22. The photoconductive composition of claim 21 in which copolymer (b) consists essentially of about 10 to about 50 mol-% of monomer (i), about 10 to about 50 mol-% of monomer (ii), and 2 to about 40 mol-% of monomer (iii).

23. The photoconductive composition of claim 19 in which the photoconductive composition is developable by an aqueous alkaline developer.

24. An electrophotographic recording element comprising:

a conductive substrate, and a layer of a photoconductive composition over the substrate:

in which the photoconductive composition comprises:

(1) at least one organic photoconductor;

(2) at least one sensitizer; and (3) a binder comprising:

(a) at least one copolymer comprising, in polymerized form, an aromatic vinyl monomer and maleic acid anhydride ring opened by a first aliphatic alcohol, and (b) at least one copolymer comprising, in polymerized form, the following monomers:

(i) $CH_2{=}CH{-}(CH_2)_n{-}OR$, in which n is 0 or 1, and R is selected from the group consisting of hydrogen, aliphatic groups having 1 to about 10 carbon atoms, and —COR' in which R' is an aliphatic group having 1 to about 10 carbon atoms, and (ii) maleic acid anhydride ring opened by a second aliphatic alcohol;

in which the composition is developable by an aqueous alkaline developer.

25. The electrophotographic recording element of claim 24 in which the substrate is selected from the group consisting of aluminum plates, zinc plates, magnesium plates, copper plates or multimetal plates.

26. The electrophotographic recording element of claim 24 in which the first aliphatic alcohol and the second aliphatic alcohol each comprise 1 to 6 carbon atoms.

27. The electrophotographic recording element of claim 24 in which monomer (i) is vinyl alcohol.

28. An electrophotographic recording element comprising:

a conductive substrate, and a layer of a photoconductive composition over the substrate:

in which the photoconductive composition comprises:

(1) at least one organic photoconductor;

(2) at least one sensitizer; and (3) a binder comprising:

(a) at least one copolymer comprising, in polymerized form, an aromatic vinyl monomer and maleic acid anhydride ring opened by a first aliphatic alcohol, and (b) at least one copolymer comprising, in polymerized form, the following monomers:

(i) vinyl alcohol; and (ii) maleic acid anhydride ring opened by a second aliphatic alcohol;

in which:

the first aliphatic alcohol and the second aliphatic alcohol each comprise 1 to 6 carbon atoms;

the molar ratio of aromatic vinyl monomer and ring opened maleic acid anhydride in copolymer (a) is from about 2:1 to 1:1;

the mixture of copolymer (a) and copolymer (b) together comprise about 20 to about 85% by weight based on the total weight of the nonvolatile constituents of the photoconductive composition;

the weight ratio of copolymer (a) to copolymer (b) is about 2:1 to about 20:1;

the organic photoconductor is selected from the group consisting of oxadiazoles, oxazoles, pyrazolines, aromatic hydrazones and triarylamines; and the sensitizer is selected from the group consisting of triarylmethane dyes, xanthene dyes, thiazine dyes, acridine dyes, quinoline dyes, quinone and ketone dyes, polymethine dyes, and cyanine dyes.

29. The electrophotographic recording element of claim 28 in which copolymer (b) consists essentially of monomer (i) and monomer (ii), and in which the molar ratio of monomer (i) to monomer (ii) is from about 1.2:1 to 1:1.

30. The electrophotographic recording element of claim 28 in which copolymer (b) further comprises, in polymerized form, monomer (iii), and monomer (iii) is selected from the group consisting of styrene, α-methylstyrene and α-chlorostyrene.

31. The electrophotographic recording element of claim 30 in which copolymer (b) consists essentially of about 10 to about 50 mol-% of monomer (i), about 10 to about 50-mol-% of monomer (ii), and about 2 to about 40 mol-% of monomer (iii).

* * * * *

UNITED STATES PATENT AND TRADEMARK OFFICE

CERTIFICATE OF CORRECTION

PATENT NO. : 6,376,144 B1
DATED : April 23, 2002
INVENTOR(S) : Baumann

It is certified that error appears in the above-identified patent and that said Letters Patent is hereby corrected as shown below:

Column 4,
Line 16, after the word "and" insert -- optionally --;

Column 6,
Line 50, delete "1 mol" and insert therefore -- .1 mol --;

Column 8,
Line 3, delete "23º0 C" and insert therefore -- 23º C --;

Table 1, footnote 1, delete "1800 000" and insert therefore -- 180 000 --;
Table 2, Comparative example 3, line "dot range", delete "20-90" and insert therefore -- 20-96 --;
Table 2, line "length of", after the words "length of", insert -- run --.

Signed and Sealed this

Thirty-first Day of December, 2002

JAMES E. ROGAN
*Director of the United States Patent and Trademark Office*